US006309273B1

(12) United States Patent
Kim

(10) Patent No.: US 6,309,273 B1
(45) Date of Patent: Oct. 30, 2001

(54) HULA HOOP

(76) Inventor: Jun Bae Kim, 871-32, Hwakok 2-Dong, Kangse-Ku, Seoul 157-012 (KR)

( * ) Notice: Subject to any disclaimer, the term of this patent is extended or adjusted under 35 U.S.C. 154(b) by 0 days.

(21) Appl. No.: 09/578,547

(22) Filed: May 25, 2000

(30) Foreign Application Priority Data

Jan. 14, 2000 (KR) ..... 00-1030

(51) Int. Cl.[7] ..... A63H 33/00; A61H 15/00

(52) U.S. Cl. ..... 446/28; 446/236

(58) Field of Search ..... 446/236, 242, 446/265, 397, 484; 482/8; 601/23, 44, 125, 136, 137

(56) References Cited

U.S. PATENT DOCUMENTS

| | | | | |
|---|---|---|---|---|
| D. 399,969 | | 10/1998 | Lin . | |
| 2,910,804 | | 11/1959 | White . | |
| 3,217,446 | | 11/1965 | Steiert . | |
| 3,337,984 | | 8/1967 | Tomasello . | |
| 4,052,982 | | 10/1977 | Ozeryansky . | |
| 4,380,885 | * | 4/1983 | Komagata | 446/236 |
| 4,480,596 | | 11/1984 | Shumiyashu . | |
| 4,480,831 | * | 11/1984 | Muller-Deinhardt | 482/8 |
| 4,850,340 | | 7/1989 | Onishi . | |
| 4,915,666 | * | 4/1990 | Maleyko | 446/242 |
| 4,917,644 | | 4/1990 | Sunshine . | |
| 5,083,964 | * | 1/1992 | Arand et al. | 446/236 |
| 5,108,340 | * | 4/1992 | Farrow | 446/242 |
| 5,139,014 | | 8/1992 | Chang . | |
| 5,338,244 | * | 8/1994 | Huang | 446/242 |
| 5,492,526 | * | 2/1996 | Chen | 446/236 |
| 5,782,743 | | 7/1998 | Russell . | |
| 5,997,449 | * | 12/1999 | Lee | 482/131 |
| 6,056,621 | * | 5/2000 | Lin | 446/236 |
| 6,059,632 | * | 5/2000 | Sassak | 446/236 |
| 6,109,999 | * | 8/2000 | Kuo | 446/236 |

FOREIGN PATENT DOCUMENTS 61-54864 4/1986 (JP) .

* cited by examiner

*Primary Examiner*—Jacob K. Ackun, Jr.
*Assistant Examiner*—Faye Francis
(74) *Attorney, Agent, or Firm*—Lee & Hong

(57) ABSTRACT

A hula hoop, comprising of a plurality of arcuate modules individually having bulged portions with a connection plug and a connection socket being formed at opposite ends of each module, is disclosed. An annular groove is formed at the tip of each bulged portion, with a raised disc-shaped flat base having a continuous tang along its circular top edge and being defined by the annular groove. A recessed locking groove is formed along the root of the base. A pressure projection and a guide projection are interiorly formed on the socket. An engaging slot is formed on the plug at a position diametrically opposite to the guide groove. An engaging projection is formed on the socket at a position corresponding to the engaging slot. A pressure dome, individually having a fitting ring, is attached to each bulged portion of the module. The lower edge of the pressure dome is seated in the annular groove with the fitting ring engaging with the tang of the base. A magnet tip or a jade tip is tightly seated in a seat formed at the top end of each pressure dome. The above seat is upwardly and inwardly inclined at its sidewall, thus forming a tapered sidewall and firmly seating the skin contact tip on each pressure dome.

15 Claims, 5 Drawing Sheets

HULA HOOP

CROSS REFERENCE TO RELATED ART

This application claims the benefit of Korean Patent Application No. 20-2000-1030, filed on Jan. 14, 2000, which is hereby incorporated by reference.

BACKGROUND OF THE INVENTION

1. Field of the Invention

The present invention relates to a circular hoop, commonly known has a hula hoop, and particularly, relates to a circular hoop consisting of a plurality of arcuate modules individually having one plug and one socket at opposite ends and being assembled into a hoop.

2. Discussion of the Related Art

A hula hoop, consisting of a plurality of, for example, 6 to 8, arcuate modules individually having one plug and one socket at opposite ends and being assembled into a hoop by inserting the plugs into the sockets, has been proposed. In the hula hoop, a plurality of guide grooves and a plurality of locking slots are formed on each of the plugs, while a plurality of locking projections are interiorly formed on the sidewall of each of the sockets. When the modules are assembled into a hoop by inserting the plugs into the sockets, the locking projections of the sockets are brought into engagement with the locking slots of the plugs. Even though the hula hoop has a good appearance, it is problematic in that the locking projections may undesirably play in the locking slots and allow the modules to be undesirably separated from each other, thus resulting in a disassembly of the hoop during use. Another problem of the above hula hoop resides in that it may be twisted at the connected junctions formed by the plugs and sockets thus disfiguring the circular shape of the hoop. The above hula hoop is thus less likely to be used. The connected junctions of such a hula hoop have been thus typically formed by screw-type connectors since the screw-type connectors accomplish a firm connection of the modules even though the connectors have a complex construction in addition to a spoiling of the appearance of the hoop. On the other hand, a plurality of pressure domes are seated on the dome seats regularly formed along the inside edge of the hoop. However, such pressure domes may be undesirably removed from the hoop since the locking force between the domes and the dome seats is not sufficient to firmly hold the domes on the seats for a lengthy period of time.

SUMMARY OF THE INVENTION

Accordingly, the present invention is directed to a circular hoop or better known as hula hoop that substantially obviates one or more of the problems due to limitations and disadvantages of the related art.

An object of the present invention is to provide a circular hoop which has improved locking projections and slots formed at the plugs and sockets of the arcuate modules, thus allowing the modules to be easily and firmly assembled into a hoop through a pressure fitting process.

Another object of the present invention is to provide a circular hoop which uses magnetic tips or jade tips as skin contact tips, thus enhancing therapeutic effects.

Another object of the present invention is to provide a circular hoop with easily replaceable tips that are attached to the pressure domes.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a circular hoop for use around a waist of a person comprises a plurality of arcuate modules serially and circularly coupled to form the hoop. Each module includes at least one bulged portion projecting toward a hoop center; a first connector and a second connector being formed at opposite ends of each of the module, wherein the first connector of the module couples with the second connector of an adjacent module; a receptacle formed on the bulged portion; a dome coupled to the receptacle of the bulged portion to make contact with the waist of the person; and a contact tip provided at a tip of the dome.

According to one aspect of the present invention, the first connector is a plug and the second connector is a socket. The plug and the socket are formed at opposite ends of each of the module. A guide groove and a locking slot are formed on the plug, and a locking projection is formed on a sidewall of the socket at a position corresponding to the locking slot.

According to another aspect of the present invention, a pressure projection and a guide projection are formed on the sidewall of the socket in a way that the pressure projection engages with the guide groove of the plug. An engaging slot is formed on the plug at a position diametrically opposite to the guide groove, and an engaging projection is formed on the inside wall of the socket at a position corresponding to the engaging slot.

According to another aspect of the present invention, an annular groove is formed at the tip of the bulged portion. A raised disc-shaped flat base has a continuous tang along a circular top edge and is defined by the annular groove with a recessed locking groove formed along the root of the base at a position under the tang.

According to another aspect of the present invention, a pressure dome is attached to the bulged portion. The pressure dome has a fitting ring formed along the inside skirt of the pressure dome. Preferably, the lower edge of the skirt is seated in the annular groove with the fitting ring engaging with the tang of the base when the pressure domes is assembled with the base. According to another aspect of the present invention, the tip placed on the dome is a magnet. Alternatively, the tip may be made of jade. Further alternatively, the hoop according to the present invention may have tips that are magnet and jade disposed in alternating order.

It is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

With reference to the drawings, and in particular to FIGS. 1–7B thereof, an adjustable axle assembly embodying the principles and concepts of the present invention will be described.

Figure 1:
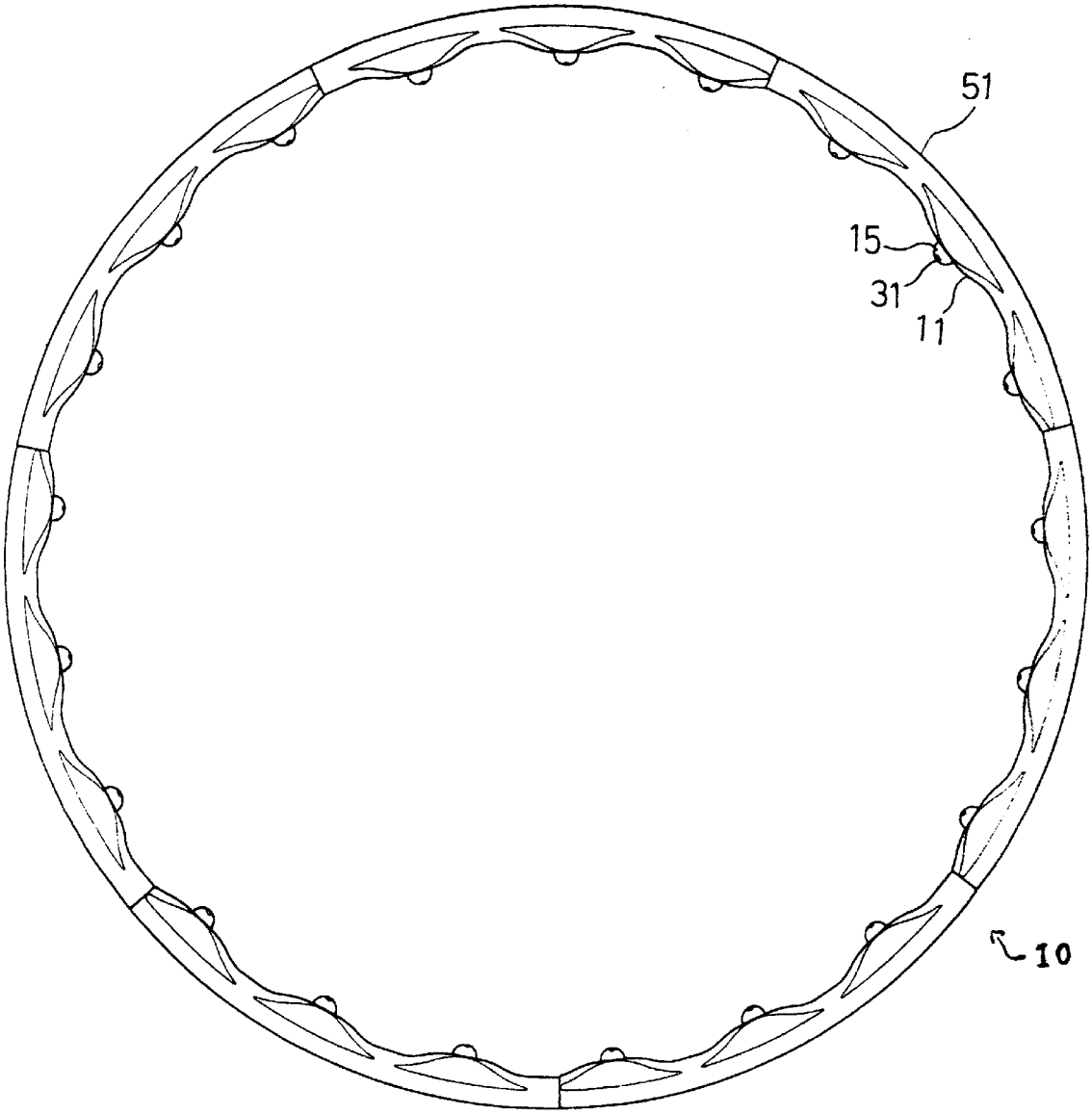
FIG. 1 is a plan view, showing the configuration of a completely assembled hula hoop comprising of a plurality of arcuate modules in accordance with the preferred embodiment of the present invention.

FIG. 1 illustrates a plan view of a completely assembled hula hoop 10 comprising of a plurality of arcuate modules in accordance with the preferred embodiment of the present invention. As shown in FIG. 1, the hula hoop 10 of this invention comprises a plurality of arcuate modules 51, which individually has a plurality of bulged portions 11 with a pressure dome 15 attached to preferably the apex of each of the bulged portions 11. A skin contact tip 31 is provided at the tip of each pressure dome 15. A connection plug 52 and a connection socket 53 are provided at opposite ends of each of the modules 51. A guide groove 54 and a locking slot 55 are preferably linearly arranged on the connection plug 52. A locking projection 56 is interiorly provided on the sidewall of the connection socket 53 at a position corresponding to the locking slot 55.

Figure 2A:
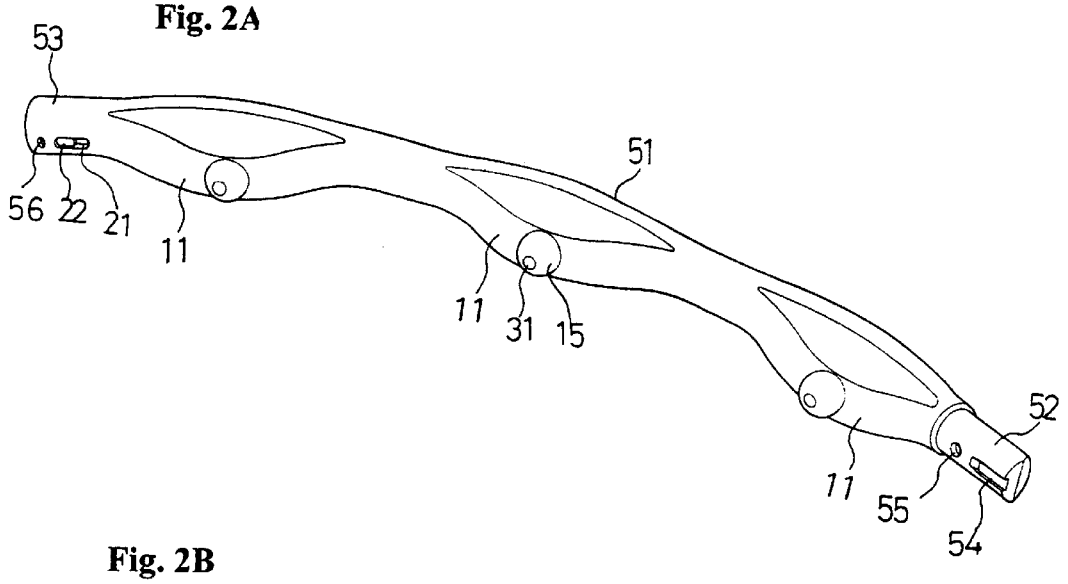
FIG. 2A is a perspective view of one arcuate module of the hula hoop of the present invention, with a plurality of pressure domes regularly set on the module.

In the hula hoop 10 and referring to FIGS. 1 and 2A, the bulged portions 11 are projecting toward the center of the hoop 10 so that when the hula hoop 10 is rotated against a waist of a person, the contact tips 31 are pressed against the body brining an accupressure effect. Preferably, the bulged portions 11 are regularly spaced apart along the length of the arcuate module 51. According to the preferred embodiment of the present invention, there are about three bulged portions 11 for each module 51.

Each of the pressure domes 15 has a fitting ring 17. The fitting ring 17 is interiorly and horizontally formed along the skirt of each dome 15 at a position slightly spaced apart from the lower edge 16 of the skirt. When such a pressure dome 15 is assembled with a base 14, the lower edge 16 of the skirt is seated in the annular groove 12 with the fitting ring 17 being fitted over the tang of the base 14.

Figure 2B:
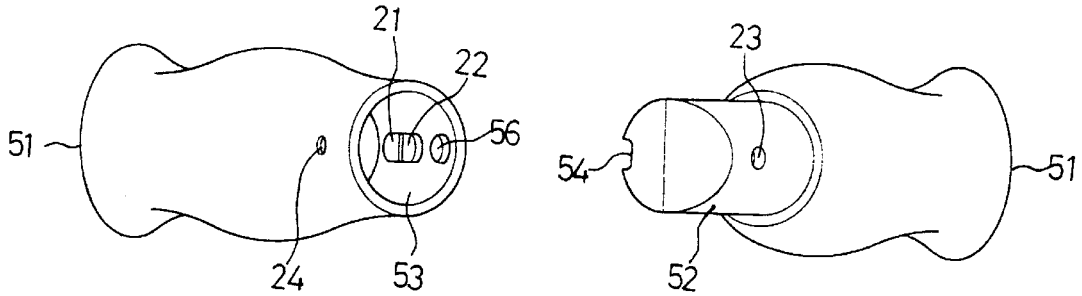
FIG. 2B is a rear perspective view of a socket and a plug formed at opposite ends of each module and used for connecting two modules into a single body.
Figure 2C:
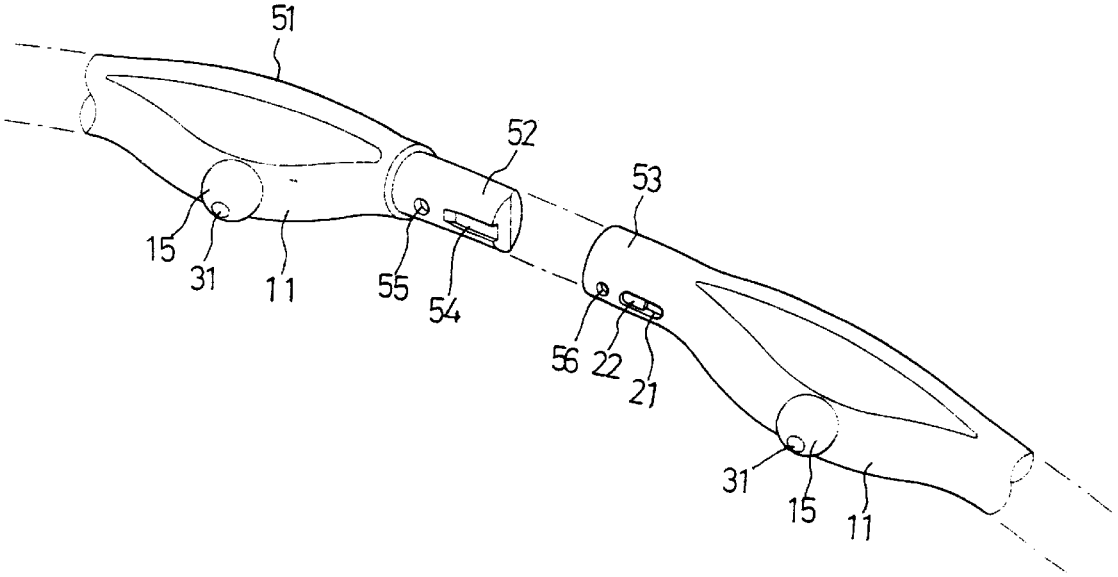
FIG. 2C is a front perspective view of a socket and a plug provided at opposing ends of two modules of the present invention.

FIG. 2A illustrates a perspective view of one arcuate module 51 of the hula hoop 10 according to the present invention, with a plurality of pressure domes regularly placed on the module 51. FIG. 2B is a rear perspective view of a socket and a plug formed at opposite ends of each module 51 and used for connecting two modules into a single body. FIG. 2C is a front perspective view of a socket and a plug provided at opposing ends of two modules 51 of the present invention. Referring to FIGS. 2A to 2C, a pressure projection 21 and a guide projection 22 are interiorly formed on the sidewall of the socket 53 in a way such that the pressure projection 21 engages with the guide groove 54 of the plug 52. On the other hand, an engaging slot 23 is formed on the plug 52 at a position diametrically opposite to the guide groove 54, while an engaging projection 24 is formed on the inside wall of the socket 53 at a position corresponding to the engaging slot 23.

Figure 3C:
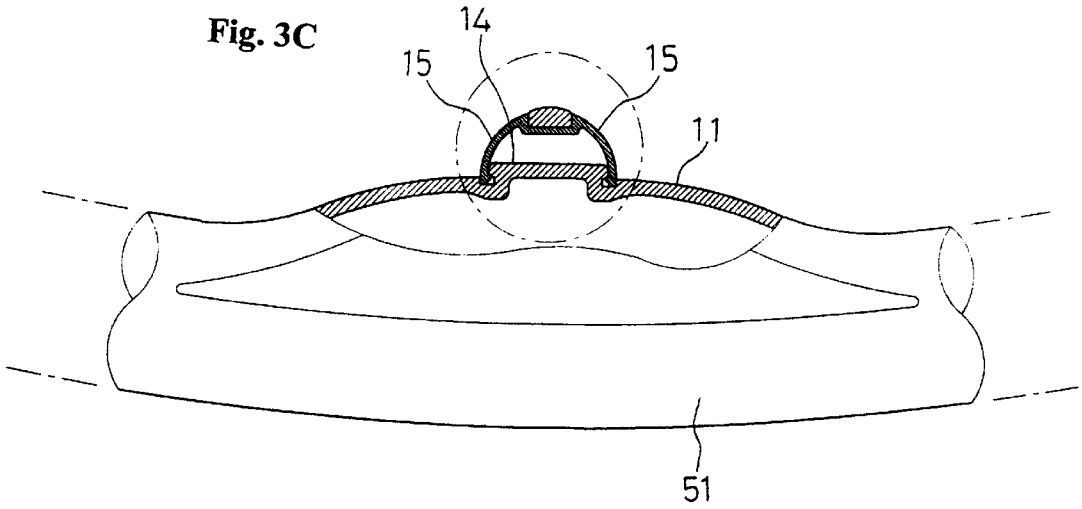
FIG. 3C is a sectional view, showing one pressure dome set on a module of the hoop of this invention.
Figure 3A:
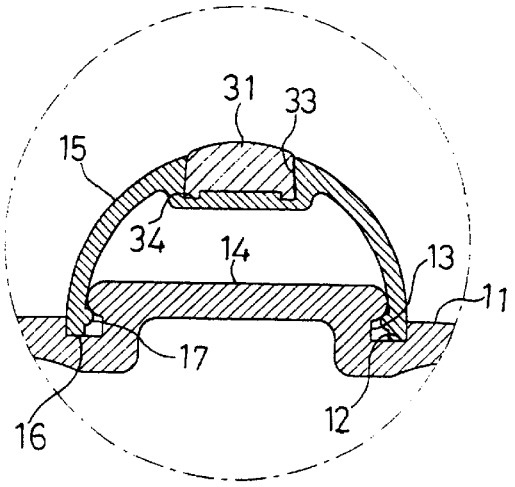
FIG. 3A is a sectional view, showing the construction of a pressure dome in accordance with a first embodiment of the present invention.

FIG. 3A illustrates a sectional view of a pressure dome 15 in accordance with a preferred embodiment of the present invention. Referring to FIG. 3A, in order to firmly place a skin contact tip 31 on each pressure dome 15, a seat or a tip receptacle is formed at the top end of each pressure dome 15 with an annular groove 34 being formed at the bottom of the seat. A circular magnet tip 31 or a circular jade tip, having a profile shape corresponding to the seat, is tightly seated in the seat. The contact tip 31 has a projection ring extending from the bottom surface thereof to fit into the annular groove 34 of the pressure dome 15. In such a case, the sidewall of the seat is upwardly and inwardly inclined, thus forming a tapered sidewall 33.

In order to firmly hold the pressure domes 15 on the bulged portions 11 of the modules 51, each module has one or more receptacles for receiving therein a corresponding pressure dome 15. The receptacle comprises an annular groove 12 formed at the tip of each bulged portion 11. The receptacle further comprises a raised disc-shaped flat base 14, having a continuous tang along its circular top edge, and is defined by the groove 12 with a recessed locking groove 13 being formed along the root of the base 14 at a position under the tang.

Figure 3B:
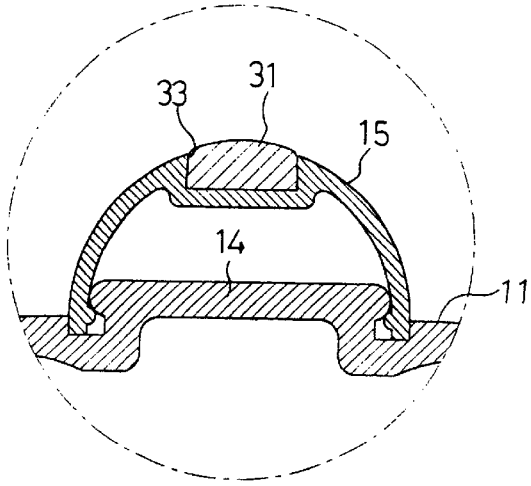
FIG. 3B is a sectional view, showing the construction of a pressure dome in accordance with a second embodiment of the present invention.
Figure 4A:
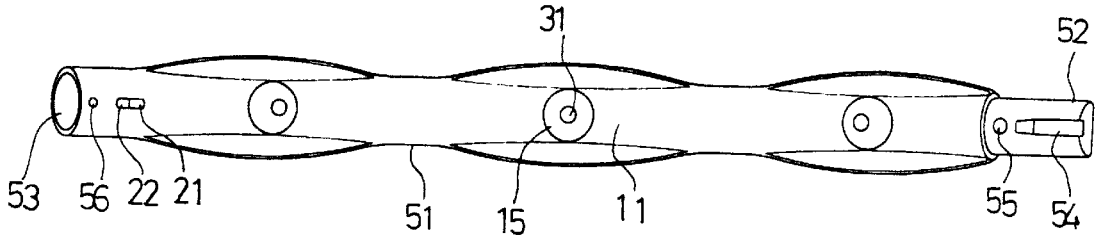
FIG. 4A is a front view of a module of this invention.
Figure 4B:
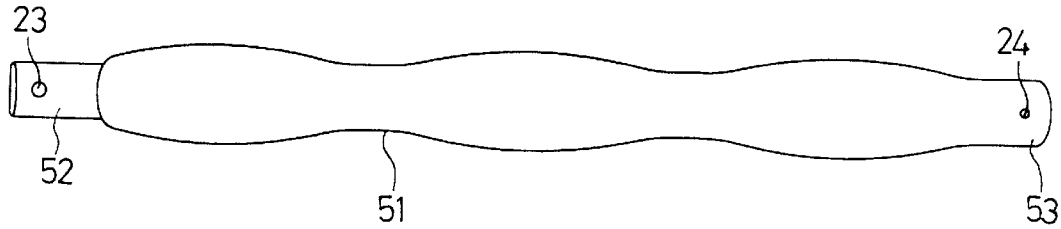
FIG. 4B is a rear view of the above module.
Figure 4C:
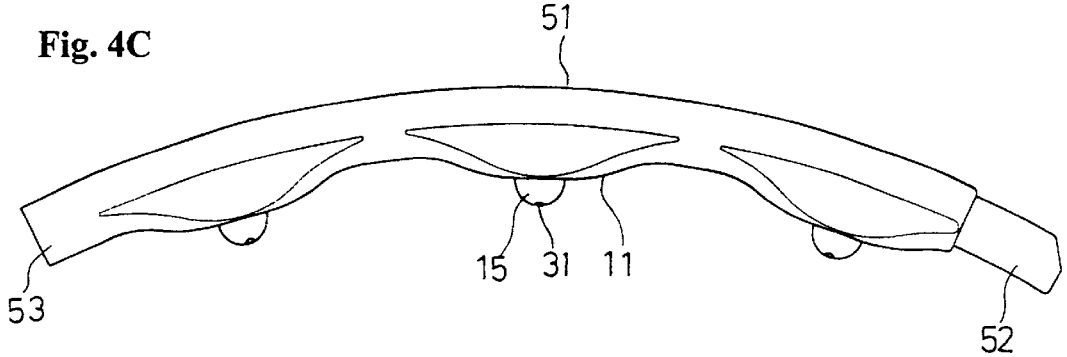
FIG. 4C is a plan view of the above module.
Figure 4D:
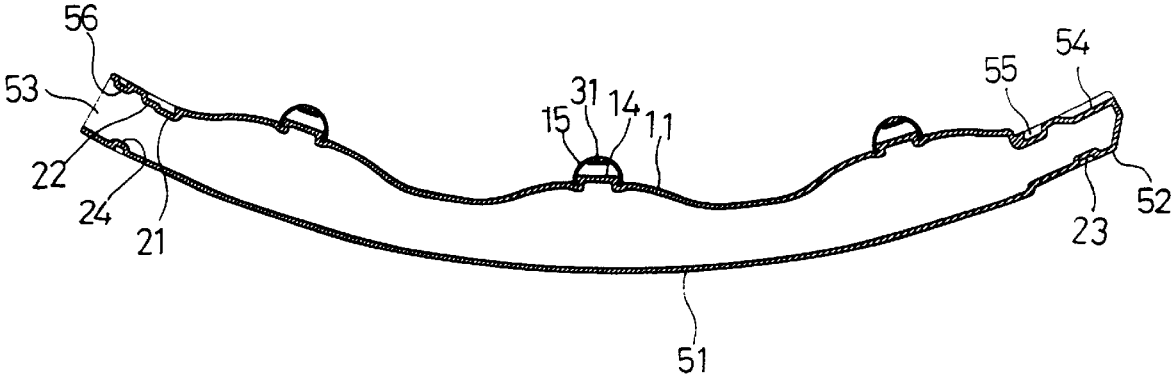
FIG. 4D is a sectional view of the above module.
Figure 5:
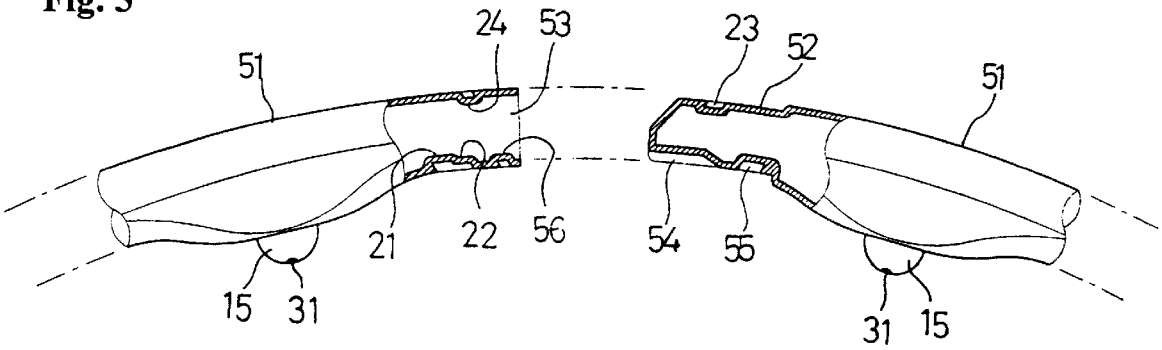
FIG. 5 is a sectional view of the socket and plug provided at opposing ends of two modules of the present invention.

FIG. 3B is a sectional view, showing the construction of a pressure dome in accordance with a second embodiment of the present invention. Referring to FIG. 3B, the contact tip 31 and the pressure dome 15 are similar to that of FIG. 3A except that the projection ring extending from the bottom surface of the contact tip 31 and the annular groove 34 of the pressure dome 15 are not present. As a result, the bottom surface of the contact tip 31 is placed flush against the bottom of the tip receptacle defined by the pressure dome 15.

Referring to FIGS. 3A to 3C, when the pressure domes 15 are set on the modules 51, each pressure dome 15 is laid on an associated base 14 with the lower edge 16 of the skirt of each dome 15 being positioned on the annular groove 12 of the base 14. Thereafter, each pressure dome 15 is firmly fitted over the base 14 by striking the top of the dome 15 using a rubber mallet. It is thus possible to set a plurality of pressure domes 15 on the modules 51. Preferably, there are three pressure domes 15 on each module 55. In such a case, the fitting ring 17 of each pressure dome 15 is elastically snapped into the recessed locking groove 13 of the base 14, while the lower edge 16 of the skirt of the dome 15 is seated into the annular groove 12 of the base 14. The skirt of the pressure dome 15 thus almost completely seals the interior of the dome 15 set on the base 14. The pressure domes 15 are thus firmly and neatly set on the modules 51, thus creating a desired appearance of the hoop while being almost free from being undesirably removed from the hoop.

Referring to FIGS. 4A to 4D and 5, a predetermined number of modules 51, preferably 7 modules 51, of this invention are easily, simply and firmly assembled into a desired hula hoop by inserting the plugs 52 of the modules 51 into the sockets 53 of neighboring modules 51. That is, when the plug 52 of a module 51 is forcibly inserted into the socket 53 of another module 51, the locking projection 56 of the socket 53 moves on the sidewall of the plug 52 under the guide of the guide groove 54 until it engages with the locking slot 55 in a conventional manner.

In addition, the pressure projection 21 of the socket 53 pressurizes the guide groove 54 while being guided by the guide projection 22, thus finally allowing the engaging projection 24 of the socket 53 to firmly engage with the engaging slot 23 of the plug 52. The engagement between the engaging slot 23 and the engaging projection 24 is reliably maintained by the pressure projection 21, thus firmly retaining the assembling of the plug 52 and socket 53. The pressure projection 21 engages with the guide groove 54 and almost completely prevents the assembled hoop from being undesirably twisted at the connected junctions.

According to the hula hoop 10 of the present invention, the skin contact tips are easily and firmly set on the modules 51. That is, in order to firmly seat the skin contact tips 31 on the pressure domes 15, a seat is formed at the top end of each pressure dome 15, with an annular groove 34 being formed at the bottom of the seat. In addition, the sidewall of the seat is upwardly and inwardly inclined, thus forming a tapered sidewall 33. A circular magnet tip or a circular jade tip, having a profile corresponding to the seat, is tightly seated in the seat. Therefore, it is possible to easily and firmly set the tips 31 on the pressure domes 15 by forcibly fitting the tips 31 into the seats formed on the domes 15.

In the present invention, either the magnet tips or the jade tips may be used as the skin contact tips 31. Alternatively, the magnet tips and the jade tips may be alternately set on the pressure domes 15 of the hoop. Alternatively, other suitable tips may be substituted therein. When a user plays with a hula hoop having the magnet tips and the jade tips alternately set along the hoop, the tips 31 form continuous cycloid curves while pressurizing the skin, affecting acupuncture spots, thus being good for the health. In such a case, the magnet tips provide a magnetic massage effect, while the jade tips provide a vital wave vibration effect.

As described above, the present invention provides a hula hoop comprising of a plurality of arcuate modules. In the hula hoop of this invention, a plurality of pressure domes are easily and firmly set on the modules since the fitting ring of each pressure dome is elastically snapped into the recessed locking groove of an associated base of the module, with the lower edge of the skirt of each dome being seated into the annular groove of the base. In addition, the locking projections and the locking slots, formed at the plugs and sockets of the arcuate modules, are brought into pressure engagement with each other, thus allowing the modules to be easily and firmly assembled into a hoop through a pressure fitting process. The hula hoop of this invention also uses magnet tips or jade tips as the skin contact tips, thus being good for the health while accomplishing an easy and firm attachment of the skin contact tips to the pressure domes.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A circular hoop, comprising:

a plurality of modules individually having a plurality of bulged portions, with a connection plug and a connection socket being formed at opposite ends of each of said modules, a guide groove and a locking slot being formed on said connection plug, a locking projection being formed on a sidewall of said connection socket at a position corresponding to the locking slot, an annular groove being formed at a tip of each of said bulged portions, a raised disc-shaped flat base having a continuous tang along a circular top edge and being defined by said annular groove with a recessed locking groove formed along the root of said base at a position under the tang, a pressure projection and a guide projection being formed on the sidewall of the socket in a way such that the pressure projection engages with the guide groove of the plug, an engaging slot being formed on the plug at a position diametrically opposite to the guide groove, and an engaging projection formed on the inside wall of the socket at a position corresponding to the engaging slot;

a pressure dome attached to each of the plurality of bulged portions, said pressure dome having a fitting ring interiorly and horizontally formed along a skirt of said pressure dome at a position slightly spaced apart from the lower edge of said skirt, a lower edge of the skirt being seated in said annular groove with the fitting ring engaging with the tang of said base when the pressure domes is assembled with the base; and a contact tip provided at a tip of said pressure dome.

2. The circular hoop according to claim 1, wherein a seat is formed at the top end of each of the pressure domes with an annular groove formed at the bottom of said seat, and said contact tip is a circular magnet tip or a circular jade tip having a profile corresponding to the seat and being tightly seated in the seat, said seat being upwardly and inwardly inclined at its sidewall, thus forming a tapered sidewall and firmly seating the contact tip on the pressure dome.

3. A circular hoop for use around a waist of a person, the hoop comprising:

a plurality of arcuate modules serially and circularly coupled to form the hoop, each module including at least one bulged portion projecting toward a hoop center;

a first connector and a second connector being formed at opposite ends of each of the module, wherein the first connector of the module is a plug and couples with the second connector of an adjacent module, the second connector being a socket;

a receptacle formed on the bulged portion;

a dome coupled to the receptacle of the bulged portion to make contact with the waist of the person; and a contact tip provided at a tip of the dome, wherein a guide groove and a locking slot are formed on the plug, and a locking projection is formed on a sidewall of the socket at a position corresponding to the locking slot.

4. The circular hoop according to claim 3, further comprising a pressure projection and a guide projection being formed on the sidewall of the socket in a way such that the pressure projection engages with the guide groove of the plug.

5. The circular hoop according to claim 4, further comprising an engaging slot being formed on the plug at a position diametrically opposite to the guide groove, and an engaging projection formed on an inside wall of the socket at a position corresponding to the engaging slot.

6. The circular hoop according to claim 3, wherein the receptacle comprises an annular groove formed on the bulged portions to receive the dome therein.

7. The circular hoop according to claim 6, wherein the receptacle further comprises a disc-shaped flat base having a circular edge and being defined by the annular groove with a recessed locking groove formed along a root of the base.

8. The circular hoop according to claim 7, wherein the dome has a fitting ring formed along an inner surface of the dome, a lower portion of the dome being seated in the annular groove with the fitting ring engaging with a base of the receptacle.

9. A circular hoop for use around a waist of a person, the hoop comprising:

a plurality of arcuate modules serially and circularly coupled to form the hoop, each module including at least one bulged portion projecting toward a hoop center;

a first connector and a second connector being formed at opposite ends of each of the module, wherein the first connector of the module couples with the second connector of an adjacent module;

a receptacle formed on the bulged portion;

a dome coupled to the receptacle of the bulged portion to make contact with the waist of the person; and a contact tip provided at a tip of the dome, wherein the tip placed on the dome is made of at least one of magnet and jade.

10. A circular hoop for use around a waist of a person, the hoop comprising:

a plurality of arcuate modules serially and circularly coupled to form the hoop, each module including at least one bulged portion projecting toward a hoop center;

a first connector and a second connector being formed at opposite ends of each of the module, wherein the first connector of the module couples with the second connector of an adjacent module;

a receptacle formed on the bulged portion;

a dome coupled to the receptacle of the bulged portion to make contact with the waist of the person; and a contact tip provided at a tip of the dome, wherein the hoop has tips that are magnet and jade disposed in alternating order.

11. A circular hoop for use around a waist of a person, the hoop comprising:

a plurality of arcuate modules serially and circularly coupled to form the hoop, each module including at least one bulged portion projecting toward a hoop center;

a first connector and a second connector being formed at opposite ends of each of the module, wherein the first connector of the module couples with the second connector of an adjacent module;

a receptacle formed on the bulged portion;

a dome coupled to the receptacle of the bulged portion to make contact with the waist of the person; and a contact tip provided at a tip of the dome, wherein the dome has a tip receptacle at an apex thereof for securely disposing the tip therein.

12. A circular hoop for use around a waist of a person, the hoop comprising:

a plurality of arcuate modules serially and circularly coupled to form the hoop, each module including at least one bulged portion projecting toward a hoop center;

a receptacle formed on the bulged portion wherein the receptacle comprises an annular groove formed on the bulged portions to receive the dome therein;

a dome coupled to the receptacle of the bulged portion to make contact with the waist of the person; and a contact tip provided at a tip of the dome, wherein the receptacle further comprises a disc-shaped flat base having a circular edge and being defined by the annular groove with a recessed locking groove formed along a root of the base.

13. The circular hoop according to claim 12, wherein the dome has a fitting ring formed along an inner surface of the dome, a lower portion of the dome being seated in the annular groove with the fitting ring engaging with a base of the receptacle.

14. The circular hoop according to claim 12, wherein the tip placed on the dome is a magnet.

15. The circular hoop according to claim 12, wherein the tip placed on the dome is jade.

* * * * *